US005765823A

United States Patent [19]

Meier et al.

[11] Patent Number: 5,765,823

[45] Date of Patent: Jun. 16, 1998

[54] APPARATUS FOR COMBINING SHEET-LIKE PRODUCTS

[75] Inventors: Jacques Meier, Baretswil; Werner Honegger, Bach, both of Switzerland

[73] Assignee: Ferag AG, Hinwil, Switzerland

[21] Appl. No.: 741,259

[22] Filed: Oct. 30, 1996

[30] Foreign Application Priority Data

Nov. 3, 1995 [CH] Switzerland ..... 03 124/95

[51] Int. Cl.[6] ..... B65H 7/20

[52] U.S. Cl. ..... 270/58.23; 270/58.22

[58] Field of Search ..... 270/58.23, 58.22, 270/58.21, 58.02, 58.08, 58.2

[56] References Cited

U.S. PATENT DOCUMENTS

| | | | |
|---|---|---|---|
| 2,273,252 | 2/1942 | Cummins | 270/58.23 |
| 2,561,070 | 7/1951 | Phythian | 270/58 |
| 2,799,496 | 7/1957 | Allenbaugh | 270/58.22 |
| 3,575,408 | 4/1971 | Cole | 270/58.22 |
| 3,796,422 | 3/1974 | Blowsky | 270/58.21 |
| 3,966,186 | 6/1976 | Helm | 270/58 |
| 3,989,234 | 11/1976 | Watkiss | 270/58.22 |
| 4,127,262 | 11/1978 | Eberle et al. | 271/12 |
| 4,471,262 | 9/1984 | Tamura et al. | 313/466 |
| 4,487,405 | 12/1984 | Stobb | 270/58 |
| 4,489,930 | 12/1984 | Baretswil | 270/55 |
| 4,494,646 | 1/1985 | Honegger | 198/459 |
| 4,706,951 | 11/1987 | Leu | 270/55 |
| 5,104,108 | 4/1992 | Honegger | 270/55 |
| 5,116,033 | 5/1992 | Honegger | 270/55 |
| 5,547,177 | 8/1996 | Merkli et al. | 270/58.22 |
| 5,560,594 | 10/1996 | Gosslinghoff | 270/58.22 |
| 5,662,319 | 9/1997 | Honegger | 270/58.2 |

*Primary Examiner*—David A. Okonsky
*Attorney, Agent, or Firm*—Brinks Hofer Gilson & Lione

[57] ABSTRACT

The apparatus has a plurality of carrying elements (20) which are arranged at a distance one behind the other on a drawing member (14), driven in the circulating direction (U). The longitudinal direction (L) of the carrying elements (20) extends at an acute angle (α) with respect to the circulating direction. At the discharge locations (36), feed devices (12) discharge a sheet-like product to each carrying element (20) which is moved past said discharge locations. While having a considerable processing capacity and a relatively low circulating speed, the apparatus requires only a modest amount of space.

10 Claims, 9 Drawing Sheets

APPARATUS FOR COMBINING SHEET-LIKE PRODUCTS

BACKGROUND OF THE INVENTION

The present invention relates to an apparatus for combining sheet-like products, in particular printed products. The apparatus has a plurality of carrying elements arranged one behind the other on a circulating drawing member. Each carrying member has a longitudinal extending product supporting member. Products and or components of products are fed to the apparatus by feed devices that have discharge locations at which products and or components of products that will be assembled into combined products are discharged to the product supporting members. The apparatus has a removal location, downstream of the discharge location at which the combined products are removed from the carrying elements.

An apparatus of this type is shown in U.S. Pat. No. 4,706,951. This apparatus has carrying elements which are arranged at a distance one behind the other on an endless drawing member and has pocket-like product supporting members, the longitudinal direction of which extends at right angles to the circulating direction. Feed devices designed as clamp-type transporters have discharge locations which are arranged one behind the other, as seen in the circulating direction of the carrying elements, and at which the clamps open to release the carried printed products. The printed products drop onto the product supporting members. Each clamp-type transporter has a section which borders its discharge location and in which the clamp-type transporter lies in a vertical plane, extending in the circulating direction, and in an inclined manner from the top towards the circulatory path of the carrying elements. Assisted by a guide, the lower, free edge of the products, which are transported in a suspended position, are introduced into the charging opening of the corresponding product supporting members. The clamp-type transporters extend at right angles to the sections in question and curve towards them.

Those sections of the clamp-type transporters which lead to the discharge locations have to be of a specific length in order, while having a high processing capacity, to ensure reliable and careful introduction of the products into the charging openings, which results in considerable overall length and a corresponding space requirement for the apparatus. Furthermore, the feed devices curve towards the discharge location, which involves a high degree of design outlay and a large amount of space.

Another similar apparatus is disclosed in U.S. Pat. No. 4,489,930. This apparatus has carrying elements which are arranged at a distance one behind the other on an endless drawing member and each has a product supporting member which extends at right angles to the drawing member and forms a receiving saddle for folded printed products. The feed devices are likewise designed as clamp-type transporters. The clamp-type transporters travel in the same direction as the circulating direction of the carrying elements.

Still another apparatus for combining printed products is disclosed in U.S. Pat. No. 5,116,033. The apparatus of this patent has carrying elements arranged one behind the other on a drawing member which driven in circulation. The longitudinal direction of the carrying elements extends in the direction of the drawing member, and thus in the circulating direction. The carrying elements are designed as saddle-like and/or pocket-like product supporting members. At the discharge locations which are arranged one behind the other, as seen in the circulating direction, feeders discharge printed products to the product supporting members. The combined sets of printed products must not overlap to permit subsequent processing. As a result the circulating speed of the carrying elements is comparatively high to thereby achieve acceptable processing capacity. However, since the feeders which form the feed devices have a feed direction which is at least approximately at right angles to the circulating direction high circulating speed is not achievable. Upon transfer to the carrying elements, the products undergo a sudden change in the direction of movement, which has an increasingly adverse effect on the products as the feed speed and the circulating speed become higher. Consequently, this apparatus has processing capacity.

Taking this prior art as a departure point, the object of the present invention is to develop an apparatus having improved processing capacity, a relatively low circulating speed and occupies a relatively small amount of space.

SUMMARY OF THE INVENTION

This object is achieved by the apparatus of this invention in which the carrying elements extend at an acute oblique angle with respect to the circulating direction of the combining conveyor.

Moreover, the oblique position of the carrying elements permits the feed devices to be designed without long sections extending in the circulating direction. Since, as a result of the oblique position, the carrying elements may be spaced apart at a distance which is less than the length of the products or components of products, as measured in the longitudinal direction of the carrying elements, only moderate circulating speeds are necessary, which ensures careful treatment of the products. As a result of the oblique position, the products or components of products are transferred carefully to the carrying elements even if the feed direction extends at right angles to, or at a large acute angle with respect to, the circulating direction. The products are deflected gently into the circulating direction.

An acute oblique-position angle is to be understood as an angle other than 0° and other than 90°. The longitudinal direction extends at an obtuse angle, which is supplementary to the oblique-position angle, with respect to the circulating direction.

DESCRIPTION OF THE PREFERRED EMBODIMENT

Figure 1:
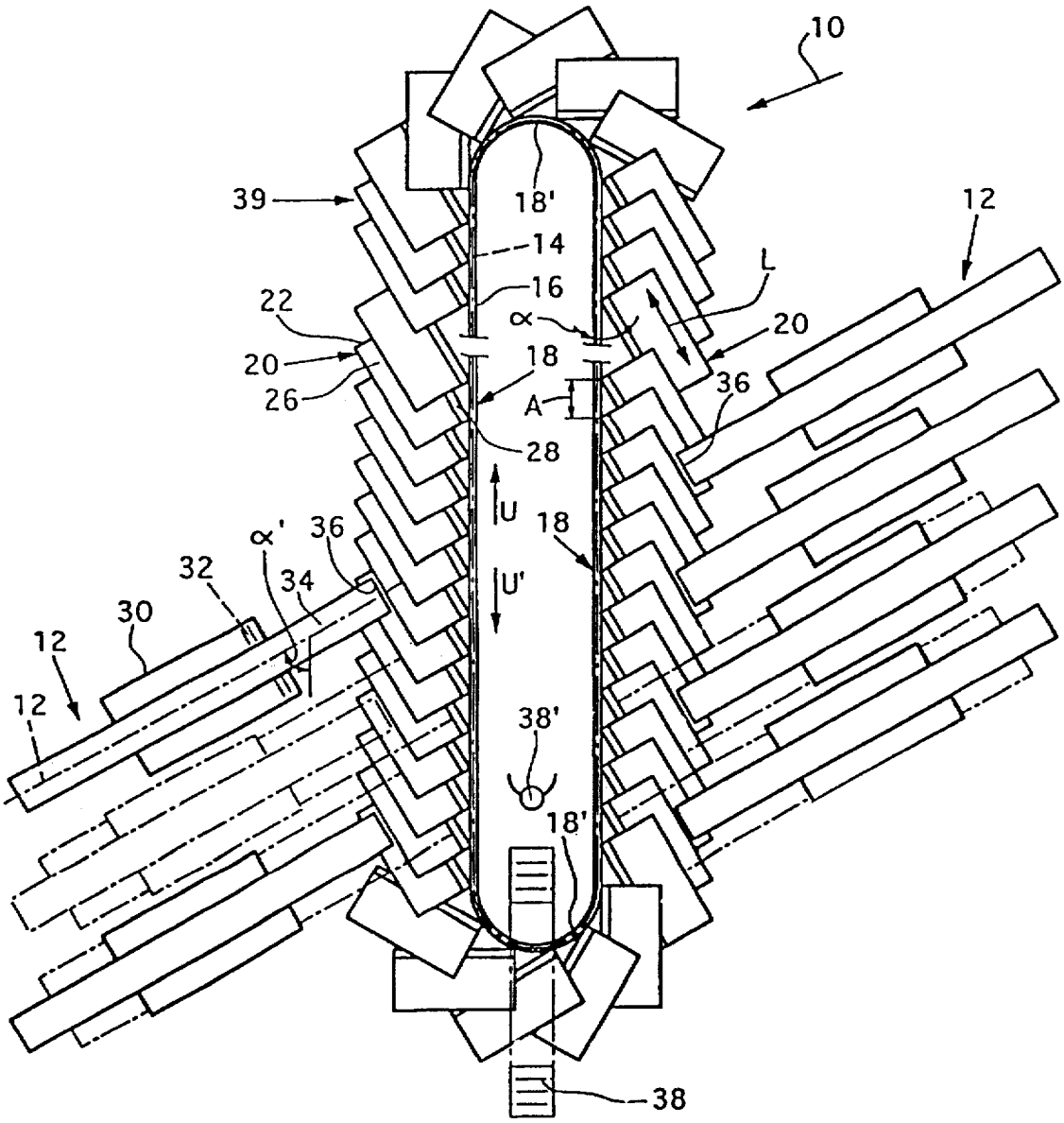
FIG. 1 shows a plan view of an inventive apparatus for combining printed products.

As can be seen from FIG. 1, the apparatus according to the invention can be constructed in a very compact manner and thus requires only a small amount of space. Depending on the type and construction of the feed devices, the oblique-position angle $\alpha$ may be smaller, or else larger, than 30°.

Figure 2:
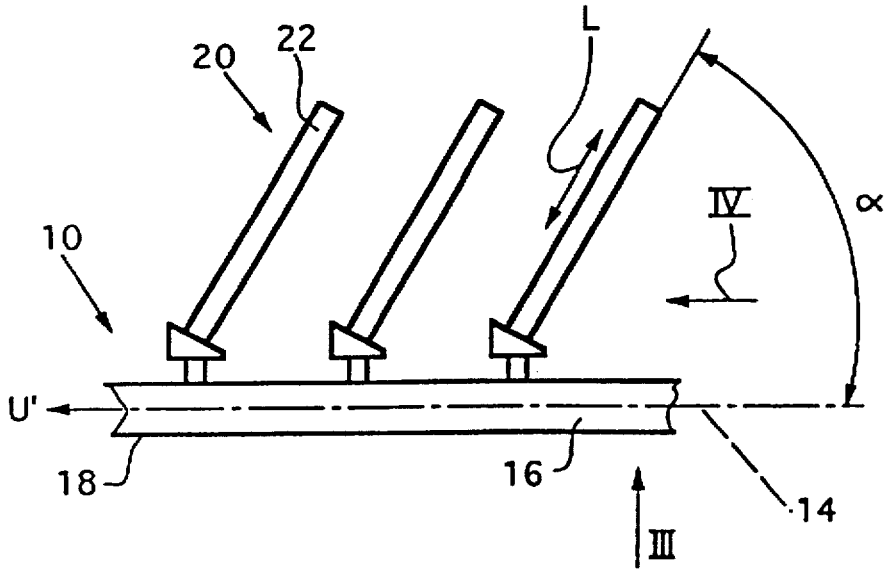
FIG. 2 shows a plan view of a first embodiment of carrying elements arranged on a drawing member obliquely with respect to the circulating direction.

It is not absolutely necessary to tilt the product supporting members 22 by an angle $\beta$. This is so, in particular, when the product supporting members 22 are designed, for example, in the manner of bars in order to form saddle-like rests for the folded printed products or components of products 32, which are deposited in a straddling manner on the product supporting members 22. FIG. 2 shows such product supporting members 22, which are likewise positioned obliquely by the angle a with respect to the circulating direction U. For the sake of completeness, it should be mentioned that, with the oblique position of the carrying elements 20, it is also possible for the drawing member 14 to be driven in the circulating direction U', which extends counter to the circulating direction U.

Figure 3:
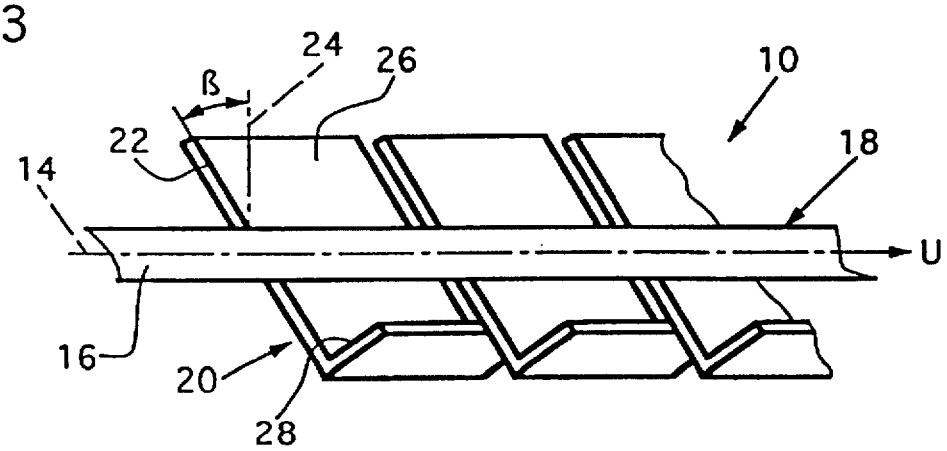
FIG. 3 shows carrying elements seen in the direction of the arrow III of FIG. 2, these carrying elements being tilted with respect to a vertical in addition to being positioned obliquely.
Figure 4:
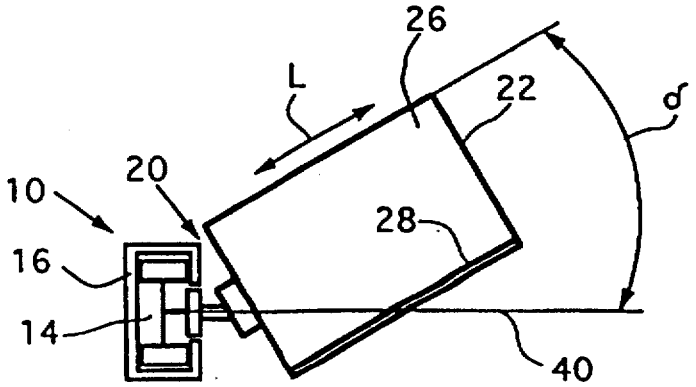
FIG. 4 shows carrying elements seen in the direction of the arrow IV of FIG. 2, these carrying elements being arranged so as to be inclined with respect to a horizontal in addition to being positioned obliquely.

FIG. 4 shows an embodiment of the combining conveyor 10 in which the longitudinal direction L of the carrying elements 20 extends at an acute angle of inclination $\delta$ in addition to being positioned obliquely by the angle $\alpha$ with respect to a horizontal 40. If the product supporting member 22 is designed in the form of an L in cross-section, as is shown in FIG. 3, it is, in addition, advantageously tilted by the angle $\beta$ with respect to a vertical.

Figure 5:
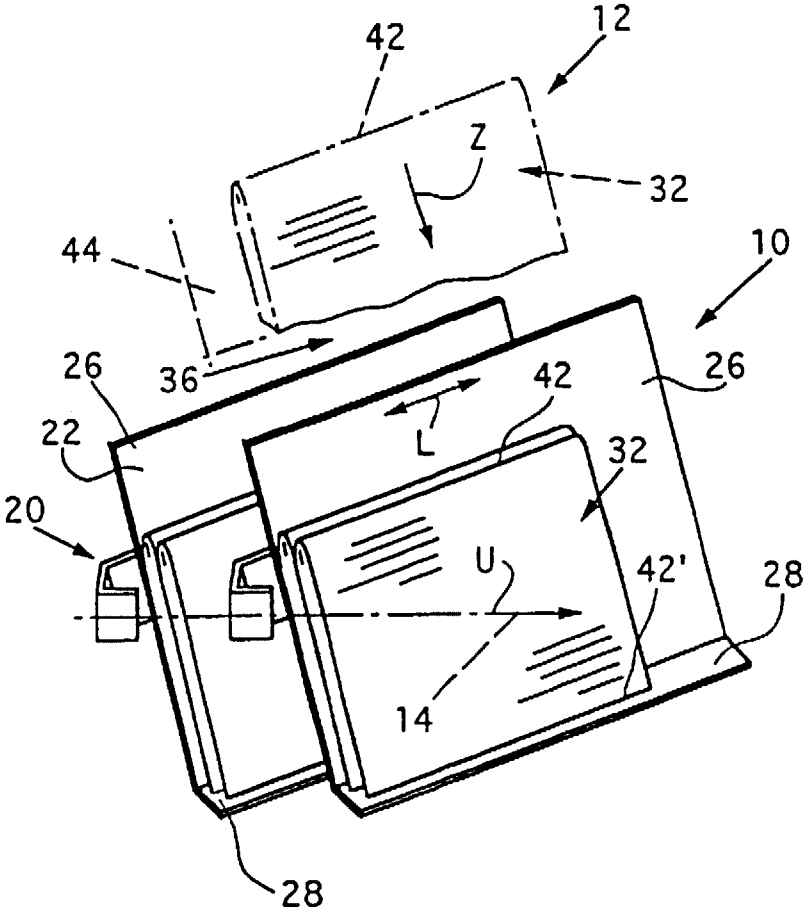
FIG. 5 shows a perspective illustration of carrying elements which are positioned obliquely and are arranged so as to be tilted and inclined and into which printed products are fed from above, for collating purposes, with that edge which is located opposite the fold in front.

FIG. 5 shows two carrying elements 20 of the combining conveyor 10 which are driven in the circulating direction U and are positioned obliquely by the angle $\alpha$ and, as in FIG. 3, are tilted by the angle $\beta$. Reference number 36 indicates the discharge location of one of the feed devices 12, at which discharge location one folded printed product 32, indicated by chain-dotted lines, is fed, in the feed direction Z. The folded printed products or components of products 32 are fed from above to each carrying element 20 with the open edge 42' which is located opposite the fold 42, the so-called bloom, in front. The printed products or components of products 32 fed to a carrying element 20 at the discharge locations 36 come to rest on the base 28 by means of their edge 42' and arranged flat one beside the other. The printed product 32 which is adjacent to the wall 26 rest flat against said wall as a result of the tilted position.

Figure 6:
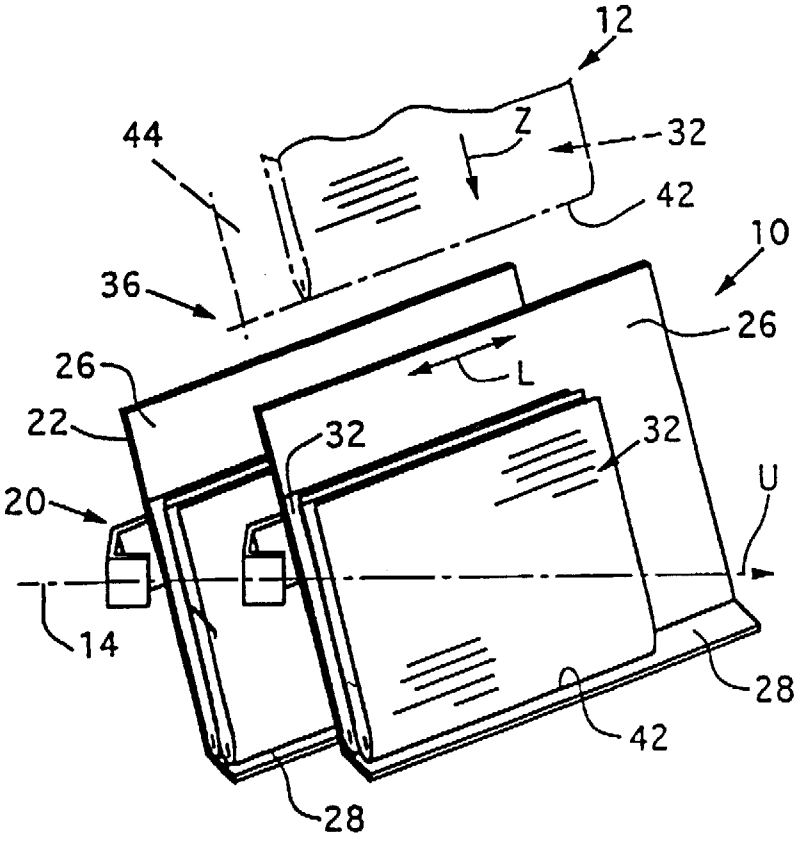
FIG. 6 shows, in an illustration which is the same as FIG. 5, carrying elements into which the printed products are fed from above, for collating purposes, with the back margin in front.

FIG. 6 shows carrying elements 20, of the type seen in FIG. 5, which are driven in the circulating direction U. The printed products 32 are fed in the direction Z. At the discharge locations 36, the printed products have the fold 42 in front, with the result that said printed products come to rest on the base 28 on their fold 42.

In the embodiments shown in FIGS. 5 and 6, the feed direction Z extends essentially at right angles to the longitudinal direction L, and a feed plane 44, in which the printed products 32 are conveyed at the discharge location 36, extends essentially parallel to the wall 26 of the relevant carrying element 20.

Figure 7:
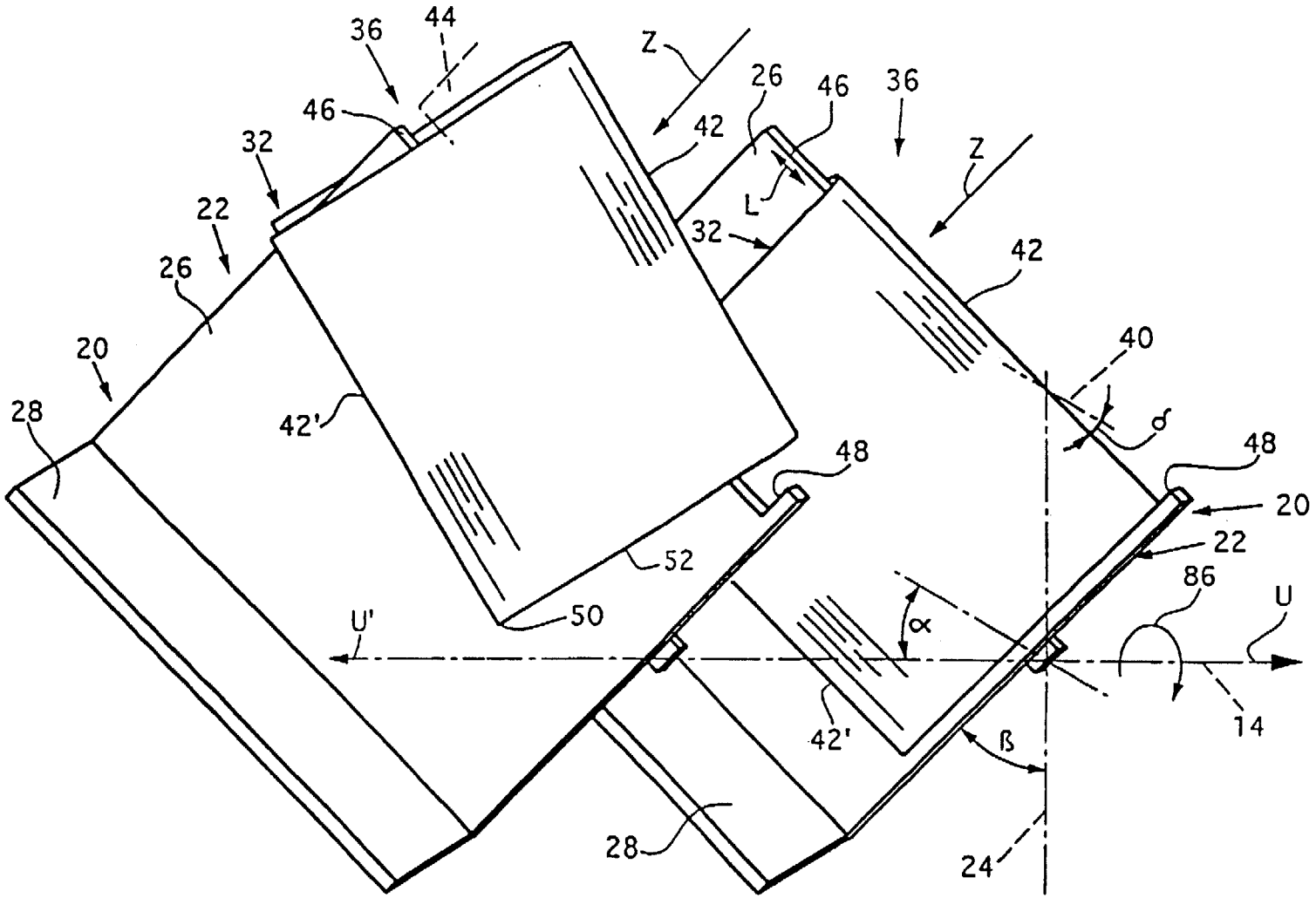
FIG. 7 shows, likewise in a perspective illustration, carrying elements which are arranged so as to be oblique, tilted and inclined, these carrying elements having, as product supporting member, saddle-like rests on which the folded printed products are deposited in a straddling manner.

FIG. 7 shows two carrying elements 20 of the combining conveyor 10 which are positioned obliquely by the angle $\alpha$ with respect to the circulating direction U and are arranged so as to be tilted by the angle $\beta$ with respect to the vertical 24 and inclined by the angle $\delta$ with respect to the horizontal 40. The upper narrow side, extending in the longitudinal direction L, of the wall 26 of the product supporting member 22 serves as a saddle-like rest 46 for the printed products 32, which, in the example shown, are fed in the feed direction Z with the edge 42' in front and in the open state and are deposited in a straddling manner on the product supporting member 22. At the lower-level end of the rest 46, the wall 26 has an upwardly projecting nose shaped section which serves as a stop 48 for the printed products 32. The printed products 32 released by the feed device 12 come to rest on the rest 46 and slide as far as the stop 48, as a result of which they are automatically aligned.

As shown for the carrying element 20, on the left in FIG. 7, the printed products 32 can be fed with a corner 50 in front, as a result of which, the printed products 32 only have to be opened at this corner. Furthermore, when the printed products 32 are fed with the corner 50 in front, the feed plane 44 may deviate considerably from a plane parallel to the longitudinal direction L. Furthermore, if the drawing member 14 is driven in the circulating direction U', the stop 48 is located at that end of the rest 46 and of the product supporting member 22 which is at the rear as a result of the oblique position. In this case, the stop 48 automatically advances towards the side edge 52, facing it, of the printed product 32 being fed, with the result that, even if the rest 46 were to extend in the horizontal direction, the printed products 32 will be aligned at the stop 48.

Figure 8:
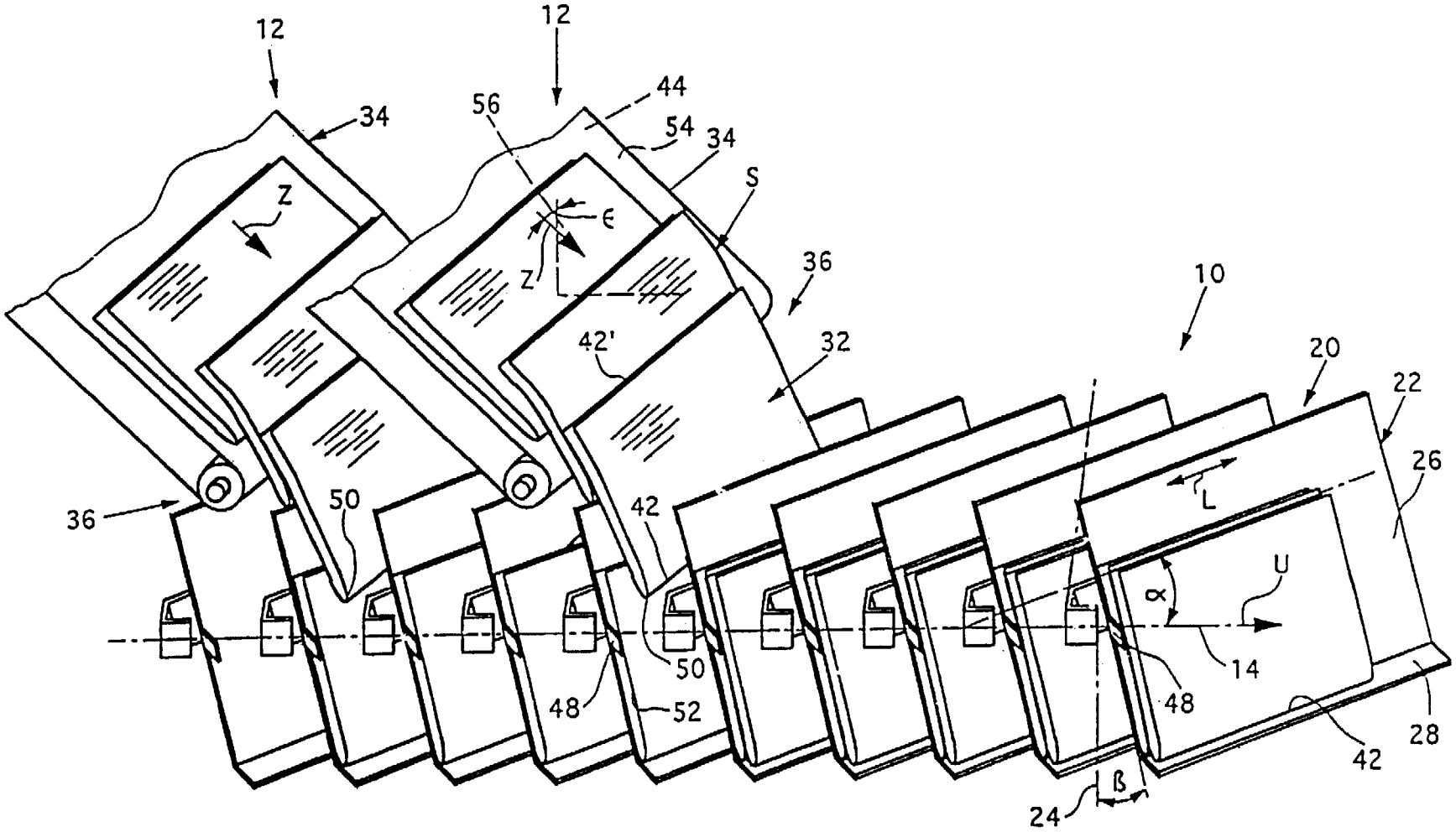
FIG. 8 shows a perspective illustration of the carrying elements which are arranged so as to be oblique and tilted and into which printed products, which are fed from above in an imbricated formation, are introduced with a corner in front, the feed direction extending obliquely with respect to a vertical plane extending in the circulating direction.

FIG. 8 shows a plurality of carrying elements 20 of the combining conveyor 10 which are arranged in the same manner as in the embodiment shown in FIGS. 5 and 6. The carrying elements 20 are positioned obliquely by the angle $\alpha$ with respect to the circulating direction U and tilted by the angle $\beta$ with respect to the vertical 24. The walls 26 have a stop 48 for the printed products 32 on the rear, trailing side edge, as seen in the circulating direction U, as a result of the oblique position. The longitudinal direction L extends horizontally.

The apparatus shown in plan view in FIG. 1 has a combining conveyor 10 and a plurality of feed devices 12. An endless drawing member 14, for example a conveying chain, is driven continuously in the circulating direction U is guided in a channel 16. The horizontally extending channel 16 has two parallel rectilinear sections 18 which are connected to one another at both ends by circle sections 18'.

Arranged at a distance A one behind the other on the drawing member 14 are carrying elements 20 which each have a product supporting member 22, which extends in the longitudinal direction L of the carrying element 20. The carrying elements 20 are arranged at an acute oblique-position angle α with respect to the circulating direction U and thus the longitudinal direction of the drawing member 14. In the example shown, this angle α is approximately 30°. As can be seen from FIG. 3, the cross-sectionally L-shaped product supporting members 22 are arranged with their sheet-like wall 26, which forms the longer leg, at an acute tilt angle β with respect to a vertical 24, said angle being smaller than 60°, and is approximately 30° in the example shown. The sheet-like shorter leg of the product supporting member 22 forms the base 28 of the carrying element 20.

Each of the feed devices 12 has a store 30 for printed products 32 (see FIGS. 1) which are fed to the carrying elements 20 by means of a conveying means 34. The discharge locations 36 of the conveying means 34, and thus of the feed devices 12, are arranged one behind the other, as seen in the circulating direction U, and the feed devices 12 are intended for discharging in each case one printed product 32 to each carrying element 20 extending past beneath the discharge location 36. The feed devices 12 are likewise positioned obliquely with respect to the circulating direction U, to be precise by an angle α' which is complementary to the angle α. The longitudinal direction L is thus at right angles to the main axis 12' of the feed devices 12.

It can be seen particularly well in FIG. 1 that the carrying elements 20 require a certain amount of time to move past a discharge location 36. This provides time, as a result of the oblique position, for discharging the printed products 32 to the carrying elements 20.

Reference is hereby made to U.S. patent application Ser. No. 08/543,325, which was filed on Oct. 16, 1995, for a more complete disclosure of construction and mode of operation of the feed devices 12. However, the feed devices 12 may differ from that design; in particular, it is conceivable for the feed devices 12 to have generally known feeders, belt conveyors or clamp-type transporters.

Reference number 38 designates a staircase which permits access to the combining conveyor 10 for an operator 38'.

Arranged downstream, from the discharge location 36 of the feed devices 12, is a removal location 39, at which the combined printed products 32 are removed from the carrying elements 20. It is also conceivable to arrange the removal location 39 at the circle section 18', and to provide additional removal locations.

The conveying means 34 of the feed devices 12 are designed as belt conveyors 54 (see FIG. 8). The printed products 32 are transported in feed direction Z such that they rest on the belt conveyors 54 in an imbricated formation S in which each printed product 32 rests on the respectively following printed product. The feed direction Z extends from top to bottom and obliquely at an angle ε with respect to a vertical plane 56, which extends in the circulating direction U at the relevant discharge location 36. As a result of this oblique position, the printed products 32, which are arranged on the belt conveyor 54 with the fold 42 extending at right angles to the feed direction Z, are fed to the carrying elements 20 with a corner 50 in front. The feed plane 44 defined by the belt conveyor 54 thus also extends obliquely with respect to the circulating direction U and may deviate from a plane parallel to the wall 26 of the carrying element 20 which is moved past the discharge location 36.

The conveying direction U extends from the side of the printed products 32 which faces the belt conveyor 54 to the side remote from said belt conveyor. Consequently, with the imbrication shown, each printed product 32 is peeled off from the respectively following printed product 32, with the result that each carrying element 20 is fed a printed product 32 at each discharge location 36. The circulating speed of the carrying elements 20 and the conveying speed of the belt conveyors 54 are coordinated with one another. Furthermore, it should be noted that, here too, the printed products 32 are automatically aligned at the stops 48 as a result of the oblique position α.

Figure 9:
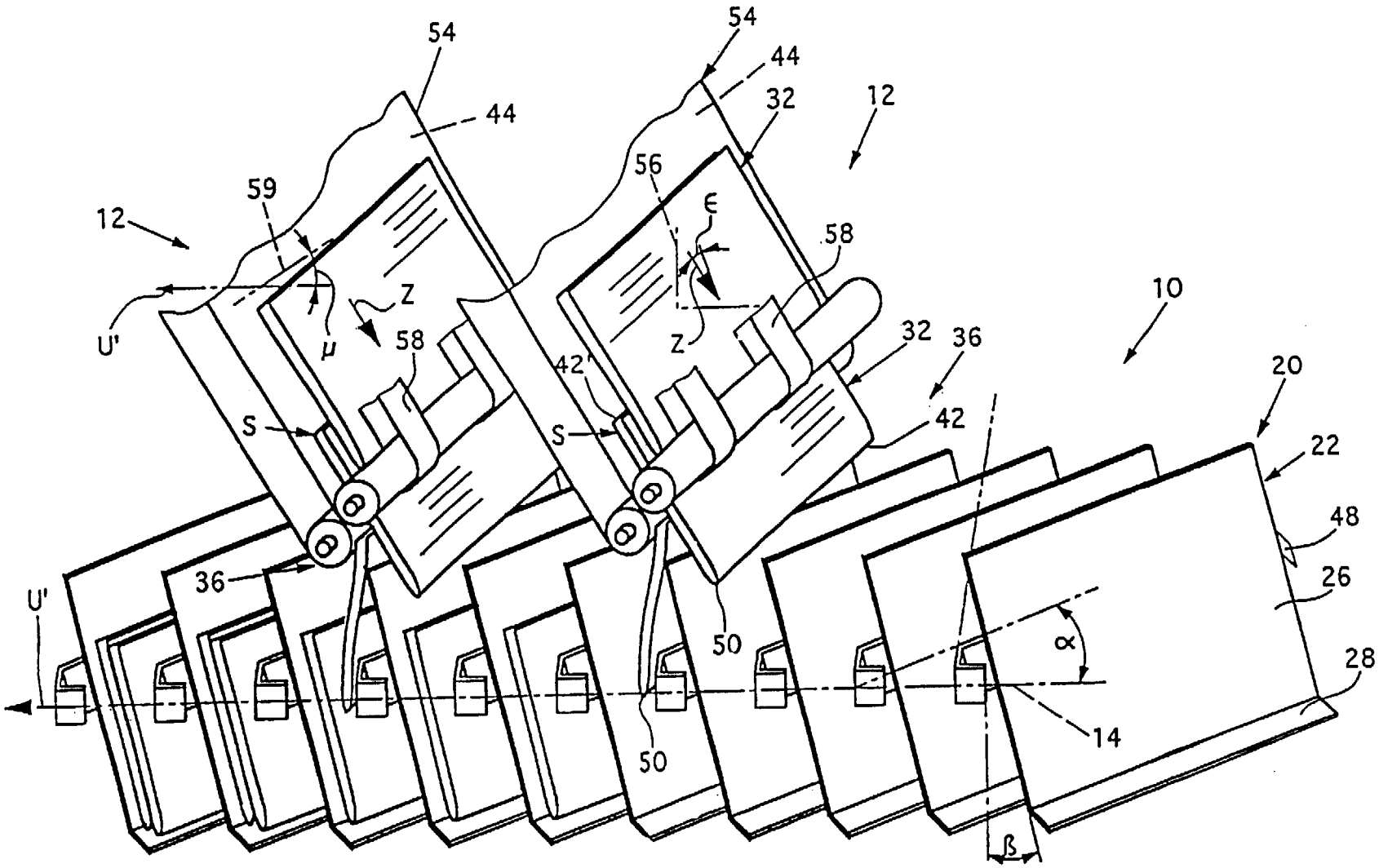
FIG. 9 shows the same illustration of the apparatus shown in FIG. 8, but with the circulating direction extending in the opposite direction and a different imbricated formation.

The combining conveyor 10 according to FIG. 9 is of a similar design to that according to FIG. 8, differs in that the circulating direction U' extends counter to the circulating direction U. The oblique-position angle is likewise indicated by α and the tilt angle is likewise indicated by β. The feed devices 12 are likewise designed as belt conveyors 54, the feed plane 44 of which is defined by these extending approximately in the vertical direction, and the feed direction Z extending from top to bottom and obliquely at an acute angle ε with respect to the vertical plane 56 extending in the circulating direction U'. The printed products 32 are likewise fed in an imbricated formation S, but here each printed product 32 rests on the preceding printed product 32, as seen in the direction counter to the belt conveyor 54. In order to prevent the printed products 32 arranged in the region of the belt conveyor 54 from falling downwards, a pair of pressure-exerting belts 58 interacts with the belt conveyor 54 in order to form a conveying gap for the printed products 32. As a result of the oblique position of the belt conveyors 54 with respect to the vertical plane 56, the printed products 32 are fed to the carrying elements 20, once again, with a corner 50 in front. Furthermore, the circulating direction U' extends from the side of the printed products 32 which is remote from the belt conveyor 54 to the side facing said belt conveyor, with the result that, with the imbrication shown, the printed product 32 discharged to a carrying element 20 is separated, once again, from the following printed product.

Furthermore, the horizontal, as indicated by reference number 59, in the feed plane 44 extends at an angle μ with respect to the circulating direction U', said angle being larger than the oblique-position angle α, but preferably smaller than 90°. As a result, when the printed products 32 are introduced into the carrying elements 20 with a corner 50 in front, the leading edge, as seen in the feed direction Z, the fold 42 in the example shown, essentially maintains a constant distance from the wall 26, which results in particularly careful handling of the printed products 32.

The same effect is achieved if, in the embodiment shown in FIG. 8, the belt conveyors 54 are arranged such that a horizontal in the relevant feed plane 44 extends at an angle with respect to the circulating direction U which is smaller than the angle α. It is likewise readily possible also to assign pairs of pressure-exerting belts 58 to the belt conveyor 54 according to FIG. 8.

If stops 48 are to be provided in the embodiment shown in FIG. 9, these are located at that end of the product supporting members 22 which is remote from the drawing member 14.

Figure 10:
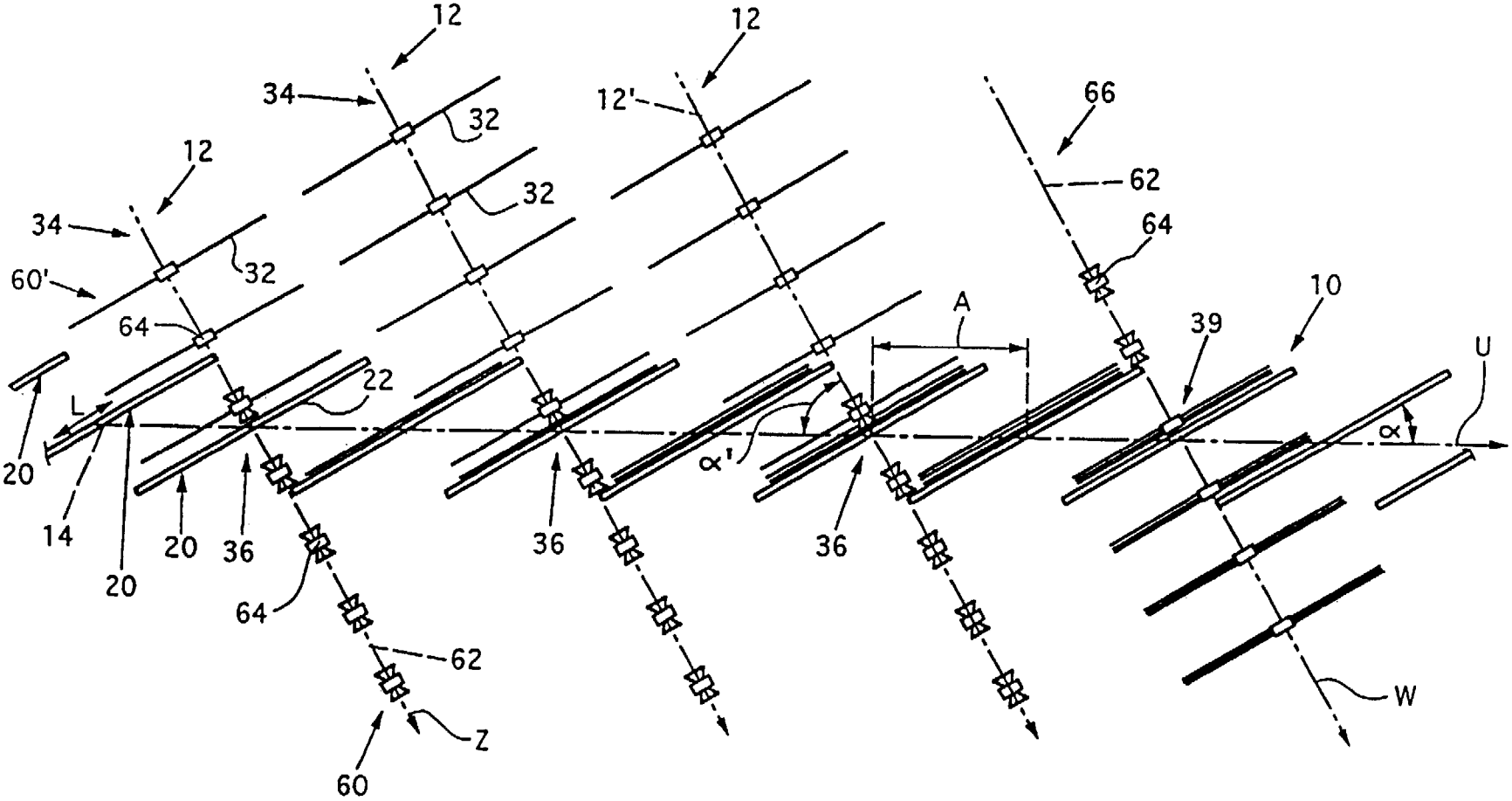
FIG. 10 shows a plan view of an inventive apparatus with feed devices which are designed as clamp-type transporters and extend in a horizontal plane.

FIG. 10 shows a schematic plan view of the carrying elements 20, which are positioned obliquely at the angle α, are driven in the circulating direction U and are arranged at a distance A one behind the other on the drawing member 14. Extending above the combining conveyor 10 are conveying means 34, for feed devices 12, which are designed as clamp-type transporters 60. The conveying means 34 extend in the horizontal direction and include a section 60' which borders the discharge locations 36 and is arranged upstream of the same. The clamp-type transporters 60 have individually controllable transporting clamps 64 which are arranged at a distance one behind the other on a circulating chain 62 and are intended for holding the printed products 32 in a suspended manner and feeding them to the combining conveyor 10 in the feed direction Z. In this arrangement, the delivery direction extends at right angles to the longitudinal direction L of the carrying elements 20 and thus at an angle α', which is complementary to the oblique-position angle α, with respect to the circulating direction U. In this embodiment of the invention, the printed products 32 are fed to the product supporting members 22, designed for example as in FIGS. 8 and 9, of the carrying elements 20 from the side. Each printed product 32 being introduced between two adjacent carrying elements 20. Opening the relevant transporting clamps 64 releases the printed products 32, which come to rest against the product supporting members 22. Introduction of the printed products takes place in section 60' of the conveying means 34.

Arranged downstream of the feed devices 12, as seen in the circulating direction U, is a removal conveyor 66 which is likewise designed as a clamp-type transporter 60. The removal conveyor 66 extends parallel to the clamp-type transporters 60 of the feed devices 12 in plan view, and is intended for gripping, by means of a transporting clamps 64, at the removal location 39 of the printed products 32. The printed products 32 are fed in each case to a carrying element 20, combined and transported away in the direction W.

Figure 11:
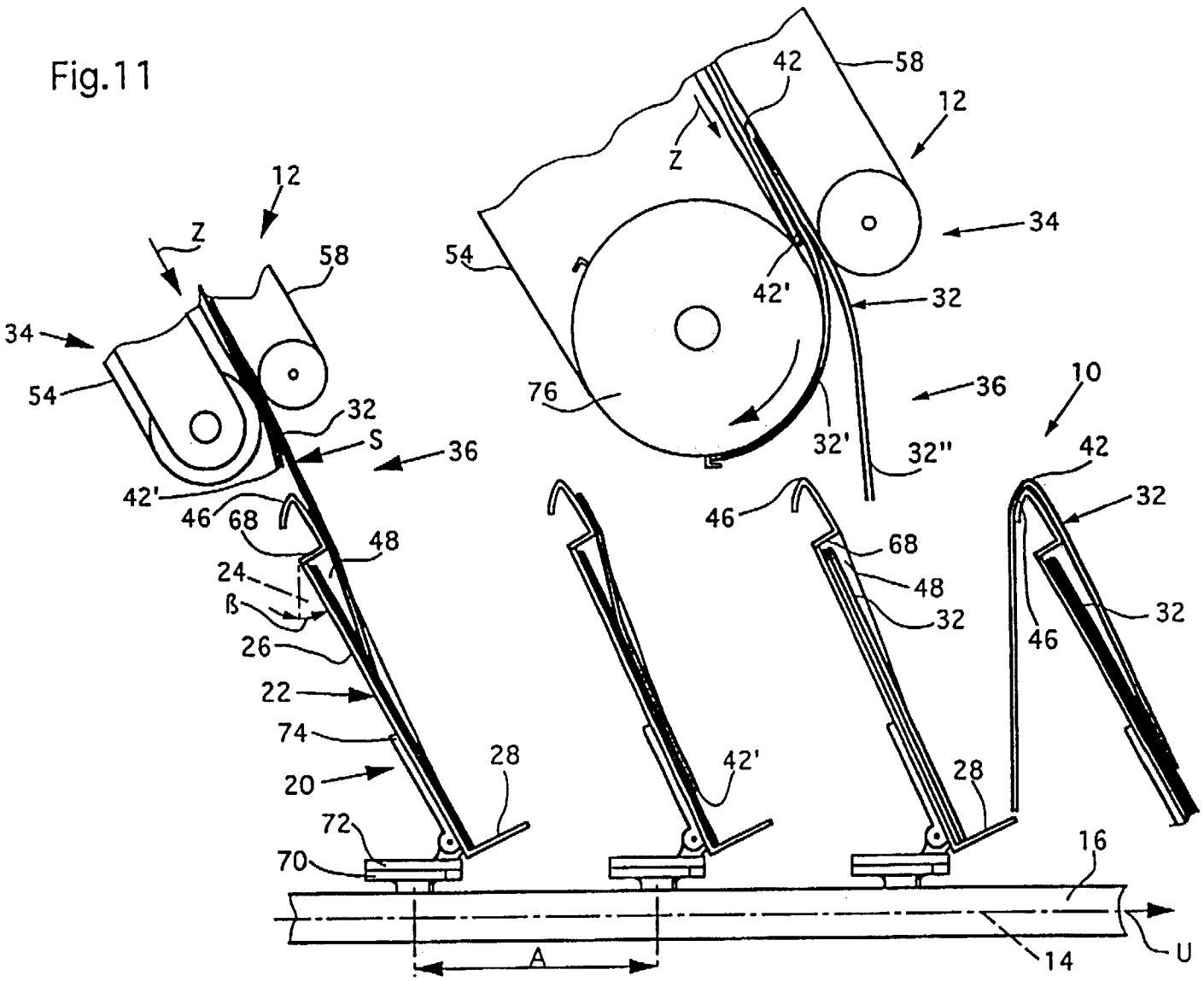
FIG. 11 shows a side view of an embodiment of carrying elements which are suitable, in particular, for the combined collating and collecting of printed products.

FIG. 11 shows part of another embodiment of the combining conveyor 10. This view is parallel to the walls 26 of the product supporting members 22, which are positioned obliquely by an angle α with respect to the circulating direction U and are arranged so as to be tilted by the angle β with respect to a vertical 24. The base 28 projects in the form of an L from the lower end of the wall 26. A top wall 68 is parallel to the base 28 and on the same side with respect to the wall 26. The top wall 68 bears a saddle-like rest 46, which projects from the upper end of said wall. In addition, a stop 48 is arranged on the wall 26, at least on the trailing, rear side, as seen in the circulating direction U. Extension arms 70 project from and are fastened to, at a distance A one behind the other, the drawing member 14. Adjustable retaining means 72 are supported on extension arms 70, which in turn supports members 22. Furthermore, mounted rotatably on the retaining means 72 is a pivot element 74 which, in the rest position, is located approximately in the plane of the wall 26.

The conveying means 34 of two feed devices 12 are shown above the combining conveyor 10. They are designed as belt conveyors 54 and each have assigned to them a pair of pressure-exerting belts 58. The printed products 32 are fed to the relevant discharge locations 36 in an imbricated formation S. The belt conveyor 54 shown on the left, in FIG. 11, discharges a printed product 32 to each carrying element 20 extending past the relevant discharge location 36, similarly to what is shown in FIG. 8. As soon as the conveying gap formed by the belt conveyor 54 and the pair of pressure-exerting belts 58 releases the printed product 32, the latter slides downwards along the wall 26, or along a printed product 32 which is already arranged in the carrying element 20. The printed product comes to rest on the base 28 by means of its lower, leading edge, in the present case by means of the edge 42' which is located opposite the fold 42. Since the distance between the base 28 and the top wall 68 is larger than the extent of the printed products 32 in this direction, the top wall 68 projects beyond said printed products if the latter are located on the base 28 and rest flatly against the wall 26, as is the case with the carrying elements 20 which are third and fourth from the left.

The belt conveyor 54 shown on the right in FIG. 11 is provided with a known opening device 76 which is intended for gripping the part 32', facing it, of each printed product 32 and for lifting said part off from the other part, designated by 32". For this purpose, the printed products 32 are conveyed with the edge 42' preceding the fold 42 in the feed direction Z. While the part 32' is held by the roller-like opening device 76 and is bent back counter to the circulating direction U, in each case one carrying element 20 extends into the part 32" which hangs down freely, whereupon the opening device 76 releases the part 32'. The printed product 32 then engages around the relevant carrying element 20 from above and, as soon as it leaves the conveying gap formed by the belt conveyor 54 and the pair of pressure-exerting belts 58, drops in a straddling manner onto the rest 46, as is illustrated for the carrying element 20 on the far right in FIG. 11 and for the carrying element 20 which is shown on the far left of FIG. 12.

Figure 12:
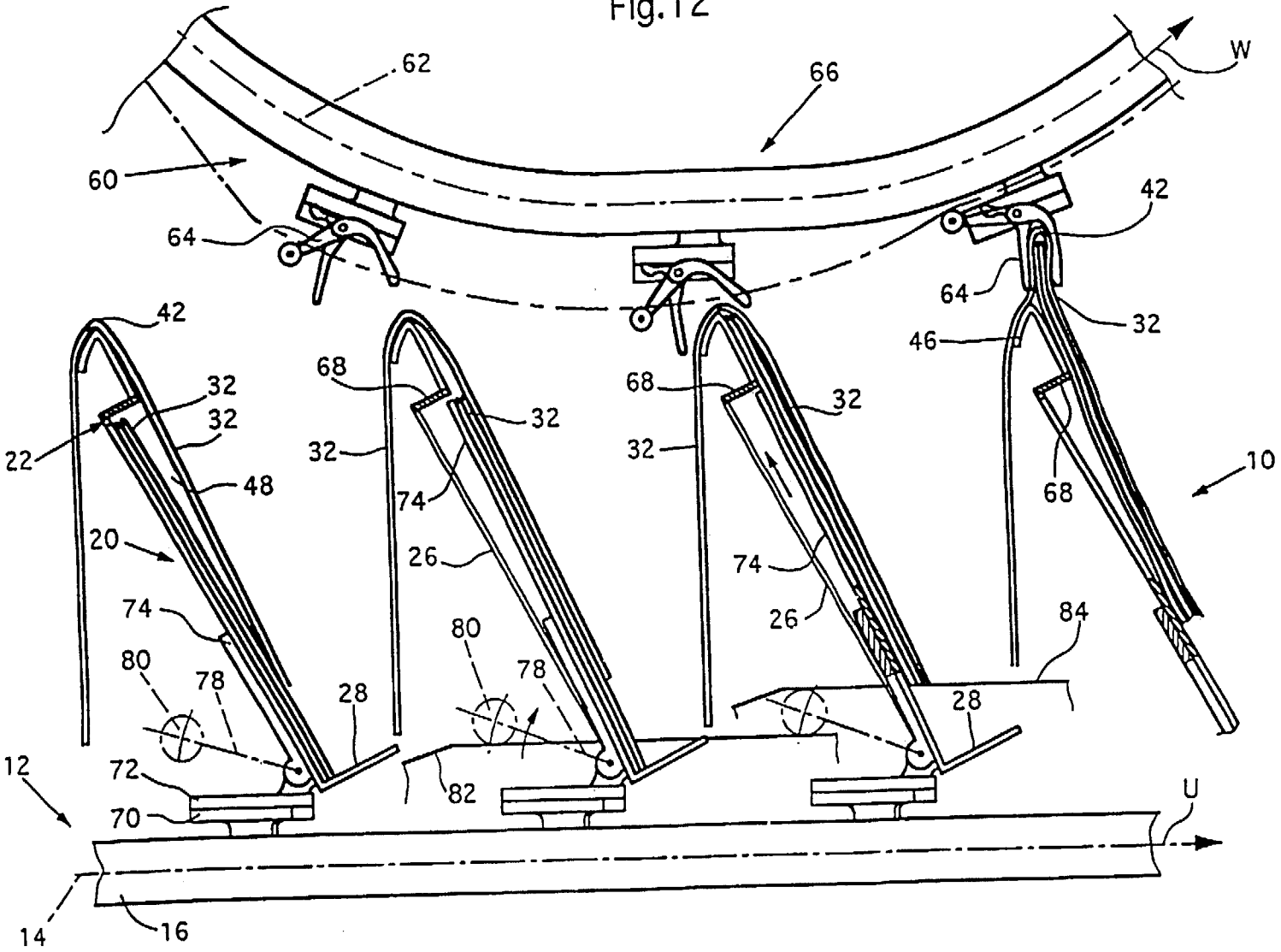
FIG. 12 shows the carrying elements according to FIG. 11 and a removal conveyor which is designed as a clamp-type transporter and is intended for removing the combined printed products.

FIG. 12 shows a detail of the combining conveyor 10 according to FIG. 11 at the removal location, which is arranged further downstream.

The pivot element 74 is connected to a pivot lever 78, at the free end of which a follow-on element 80, for example a roller, is mounted in a freely rotatable manner. The follow-on element 80 interacts with a stationary pivoting guide 82, to pivot the pivot element 74 from the rest position into an operating position, in which it is at least virtually aligned with that end of the top wall 68 which is remote from the wall 26. The pivot elements 74, of the two carrying elements 20 in the center of the four carrying elements 20 shown in FIG. 12, are located in the operating position.

The wall 26 and the base 28 each have, on both sides of the pivot element 74, a recess (not shown) which opens towards the bottom. A lifting guide 84 engages the recess that opens toward the bottom at the removal location. Said lifting guide 84 functions to lift those printed products 32 which are located on the base 28 until they are located at least virtually at the upper end of the rest 46. In this arrangement, the pivot element 74 when located in the operating position ensures that the printed products 32 which are to be lifted cannot be in a position at which their top edge collides with the top wall 68.

A removal conveyor 66 designed as a clamp-type transporter 60 extends above the combining conveyor 10. The transporting clamps 64 arranged on the chain 62 driven in the removal direction W advance towards the combined printed products 32 from above and grip said printed products by virtue of the relevant transporting clamps 64 being closed. The rests 46 have an approximately central recess, as seen in the longitudinal direction, which makes it possible for the printed products 32 to be gripped. The closed transporting clamps 64 then secure the combined printed products 32 for the purpose of transporting them away, as is illustrated at the carrying element 20 on the far right in FIG. 12 and by the associated printed products 32.

As a result of the oblique position of the carrying elements and of the feed devices, the interengagement of the carrying elements and of the printed products may be compared to the meshing of a helical-tooth rack with a helical-tooth gear wheel, the axis of said gear wheel extending in a skewed manner with respect to the longitudinal direction of the rack.

In a manner similar to the engagement between rack and gear wheel, the printed products and carrying elements 20 are guided gently one into the other according to the present invention.

For the sake of completeness, it should be mentioned that it is possible to change the angle of inclination δ, for example by twisting the channel 16, as indicated by the arrow 86 in FIG. 7.

It should further be mentioned that, for removing the printed products 32 from the carrying elements 20, the said printed products may be displaced in the longitudinal direction L, for example by means of a guide, with the result that they then project laterally beyond the carrying elements 20. The combined products may then be gripped, by the projecting section, for example by means of a clamp-type transporter, and transported away.

I/we claim:

1. An apparatus for combining sheet-like products, in particular printed products, having; a drawing member, said drawing member being driven in a circulating direction, a plurality of carrying elements secured one behind the other at a given distance apart to said drawing member, said carrying elements extending along a longitudinal direction, each of said carrying element including a product supporting member, which extends in said longitudinal direction of its corresponding carrying element, feed devices, each of said feed device having a discharge locations, said discharge locations being arranged one behind the other, along the circulating direction of said drawing member;

said feed device adapted to discharge a product or product component as a carrying element moves past said discharge location and said product or product components being received by said product supporting member upon which they are assembled into combined products, a removal location which is arranged downstream of the discharge locations and at which the combined products are removed from the carrying elements, and wherein: the longitudinal direction of the carrying elements extends at an acute oblique-angle with respect to the circulating direction.

2. The apparatus as claimed in claim 1, wherein the longitudinal direction of the carrying elements deviates from the horizontal at an acute angle of inclination.

3. The apparatus as claimed in claim 1, wherein the carrying elements have a stop for the products at that end of the product supporting members which is trailing, as seen in the circulating direction, as a result of the acute oblique-angle.

4. The apparatus as claimed in claim 2, wherein the carrying elements have a stop for the products at the lower-level end of the two ends of the product supporting members, as seen in the longitudinal direction.

5. The apparatus as claimed in claim 1, wherein the product supporting members have a sheet-like wall element and the latter is arranged in a manner pivoted out of the vertical by an acute tilt angle, which is preferably smaller than 60°, and wherein the product supporting members have a base element.

6. The apparatus as claimed in claim 1, wherein the carrying elements overlap one another in the circulating direction.

7. The apparatus as claimed in claim 1, wherein, at the discharge locations, the feed devices define a feed plane for the products which extends at an acute angle with respect to, or parallel to, the oblique position of the carrying element which is moved past the discharge location.

8. The apparatus as claimed in claim 1, wherein, at the discharge locations, the feed devices have a feed direction which extends transversely with respect to the longitudinal direction of the carrying elements which are moved past the discharge locations, in order to feed the products to the carrying elements with a corner in front.

9. The apparatus as claimed in claim 1, wherein, at the discharge locations, the feed devices have a feed direction which extends obliquely with respect to a vertical plane extending in the circulating direction at the respective discharge location.

10. The apparatus as claimed in claim 1, wherein the feed devices have clamp-type transporters for transporting the products in a suspended manner, said clamp-type transporters including a feed section, said feed section bordering the discharge locations, extends above the carrying elements, which are moved past the relevant discharge location, in a direction which is at least approximately at right angles to the oblique position of said carrying elements.

* * * * *